US006400277B2

(12) United States Patent
Guedes

(10) Patent No.: US 6,400,277 B2
(45) Date of Patent: Jun. 4, 2002

(54) MONITOR FOR DETECTING FAILURES OF NEON SIGN TRANSFORMERS

(75) Inventor: Jose Carlos Guedes, São Paulo (BR)

(73) Assignee: Industria Electro Mecanica Linsa Ltda., Sao Paulo (BR)

( * ) Notice: Subject to any disclaimer, the term of this patent is extended or adjusted under 35 U.S.C. 154(b) by 0 days.

(21) Appl. No.: 09/863,708

(22) Filed: May 23, 2001

(30) Foreign Application Priority Data

Jun. 2, 2000 (BR) ..... PI 0002057

(51) Int. Cl.[7] ..... G08B 21/00

(52) U.S. Cl. ..... 340/646; 340/641; 340/653; 340/657; 340/664; 356/330; 356/440; 356/70; 356/73

(58) Field of Search ..... 340/646, 641, 340/653, 657, 664; 356/330, 440, 70, 73

(56) References Cited

U.S. PATENT DOCUMENTS 4,351,013 A * 9/1982 Matsko et al. ..... 361/96
4,654,806 A * 3/1987 Poyser et al. ..... 364/551
5,450,002 A * 9/1995 Dunk ..... 323/257
5,936,715 A * 8/1999 Shapanus et al. ..... 356/70

* cited by examiner

*Primary Examiner*—Daniel J. Wu
*Assistant Examiner*—Tai Tan Nguyen
(74) *Attorney, Agent, or Firm*—Notaro & Michalos P.C.

(57) ABSTRACT

A monitor for detecting failures in the installation of neon gas sign transformers has an electronic circuit in the transformer compartment to turn the transformer off in the event any failure occurs. The monitor uses a programmed digital micro-controller connected to the transformer and supplies an exciting current to a "TRIAC" that turns on/off the primary coil of the transformer under an AC voltage of the distribution network and also supplies a current to turn on a red LED when failures occur and a green LED that indicates if any power is being fed from the distribution network. When the sign lights properly, the TRIAC is activated, the transformer remains activated and the red LED remains inactivated while the green LED remains activated. When there is any failure the monitor detects the failure immediately and the transformer is turned off and six seconds later it is automatically turned on again. If the cause of the failure disappears, the transformer continues operating regularly. However, if the failure is not overcome, the transformer is switched off for a second time, and six seconds later the transformer is switched on again. If even so the failure is not overcome, the transformer is switched off for the third time, at which time a warning LED starts blinking also showing the type of failure by its blinking rate.

7 Claims, 3 Drawing Sheets

MONITOR FOR DETECTING FAILURES OF NEON SIGN TRANSFORMERS

FIELD AND BACKGROUND OF THE INVENTION

The present specification is directed to a monitor for detecting failures in the installation of neon gas light transformers comprised of an electronic circuit installed within the transformer compartment in order to control and turn off the transformer in the event any failure may occur. A neon gas sign of the invention has one or more neon tubes.

As is known, a number of failures may occur in a transformer used for the purpose of supplying power to neon gas signs, and the inventive monitor was realized to detect such failures in order to overcome them. Three main types of failures can occur in a transformer. The monitor of the invention is able to detect these individually or in any combination, sequentially or not. The first type of failure is when an interruption of the secondary current is caused by any broken neon gas tube or interruption along the high-voltage cables. The second type of failure that may occur is when there is a current leakage from the secondary coil to the ground wire that is caused by a high-voltage leakage, when the insulation of the high-voltage cable connected between the transformer and the neon gas sign is not suitable. The third type of failure is when the transformer case is not correctly connected to the ground wire of the installation, due to a broken ground wire or even an incorrect installation.

Currently when the above mentioned failures occur in the installation of neon gas sign transformers, the transformer remains activated, thus supplying unnecessary power, and this is dangerous in view of the fact that it has a high-voltage outlet that can reach up to 15,000 Volts, remaining in this condition until the failure is overcome. Therefore, the world-wide market requires more safety in this particular. See the standard imposed by the United States called USA-UL2161; that sets out measures for preventing neon gas sign transformers from remaining active when the above mentioned failures occur.

SUMMARY OF THE INVENTION

In order to satisfy this market demand, the present applicant has developed a monitor for detecting failures in the installation of neon gas sign transformers based on a programmed digital micro-controller that is connected to the transformer. For this disclosure a neon gas sign is a sign with one or more neon tubes. The secondary coils are connected to the transformer. The secondary coils are connected to the ground wire through optical couplers and the output signal of the optical couplers provide the micro-controller with the current "status" of the condition of the transformer secondary. The micro-controller provides a "TRIAC" with an exciting current that turns on/off the primary of the transformer under the AC voltage of the distribution network and also supplies a current to turn on a red LED when there is a failure and a green LED that indicates if any failure has occurred.

When the neon gas sign operates regularly, the TRIAC is activated and the transformer remains activated and the red LED remains inactivated while the green LED remains activated. When there is any failure in the installation, the monitor detects the failure immediately, and the transformer is immediately turned off and six seconds later it is automatically turned on again. If the cause of the failure has disappeared, the transformer continues operating normally.

However, if the failure persists, the transformer is switched off for a second time, and six seconds after the transformer is switched on again. If the failure still persists, the transformer is definitively switched off for a third time, at which time a warning LED starts blinking also showing the type of failure that took place until a maintenance expert comes to the site and makes the required repair.

The purpose of the warning LED is to guide the maintenance expert by showing the type of failure that took place, in the following way: one blink per second to indicate that the load of the secondary is interrupted, meaning that there is a broken neon tube or gas sign or wire; two blinks per second to indicate current leakage escape through the cables of the transformer secondary and; three blinks per second to indicate the lack of connection with the ground wire of the installation. Thus, the maintenance expert will be able to repair the failure in a quick and quite sure way, because any time the warning LED blinks under any of the above mentioned conditions the transformer will be switched off. On the other hand, after repairing the failure, the expert must wait at least one minute before connecting the transformer to the distribution network again, because if the power is supplied to the transformer before one minute has elapsed, the protection circuit continues storing the failures that took place previously and it will not allow the transformer to start operating again. Only after said one minute period has elapsed with the transformer switched off all the failures stored in the protection circuit are overcome and the transformer can be switched on again with zero failure.

The monitor for detecting failures is also provided with a deactivating button that makes it possible to intentionally connect it to the transformer for a time not longer than twenty minutes. This intentional connection can only be used when failures are caused by a broken neon gas sign, or tube or tubes or a current leakage through the cables or wires of the transformer secondary. For safety reasons, the deactivating button cannot be activated when the failure is due to lack of connection with the ground wire of the installation. This button is provided to make it easier to find the failure for the sake of maintenance of the neon gas sign.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
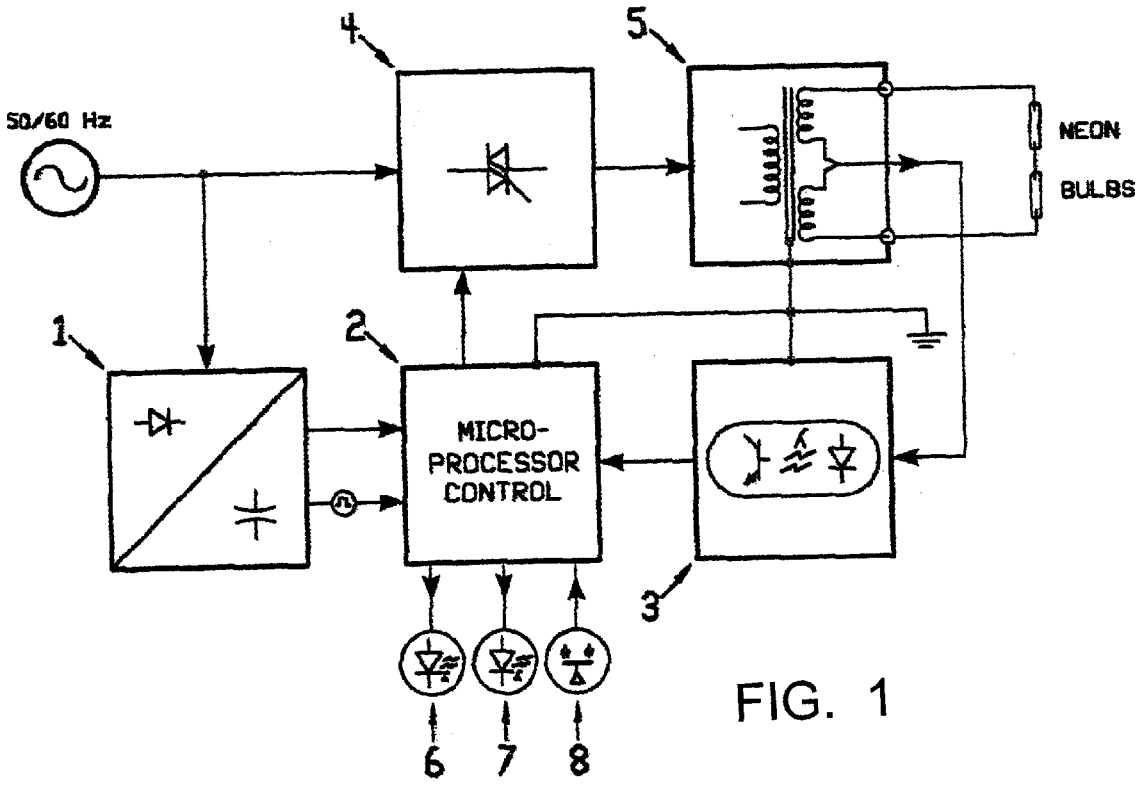
FIG. 1 is a block diagram showing the major components of the present invention.

The monitor of the present invention detects failures in operation synchronously in an electric power network, by triggering a TRIAC 4 in FIG. 1. This minimizes an initial magnetizing current surge and, with an adequate selection of activation delay times of both analog and digital parts of the invention, a programmed micro-controller has a high sensitivity, which is free from false activation. The invention can thus operate in conjunction with a mechanical blinking device or sequential electronic programmer usually used in the power of circuits of neon gas sign.

Figure 2:
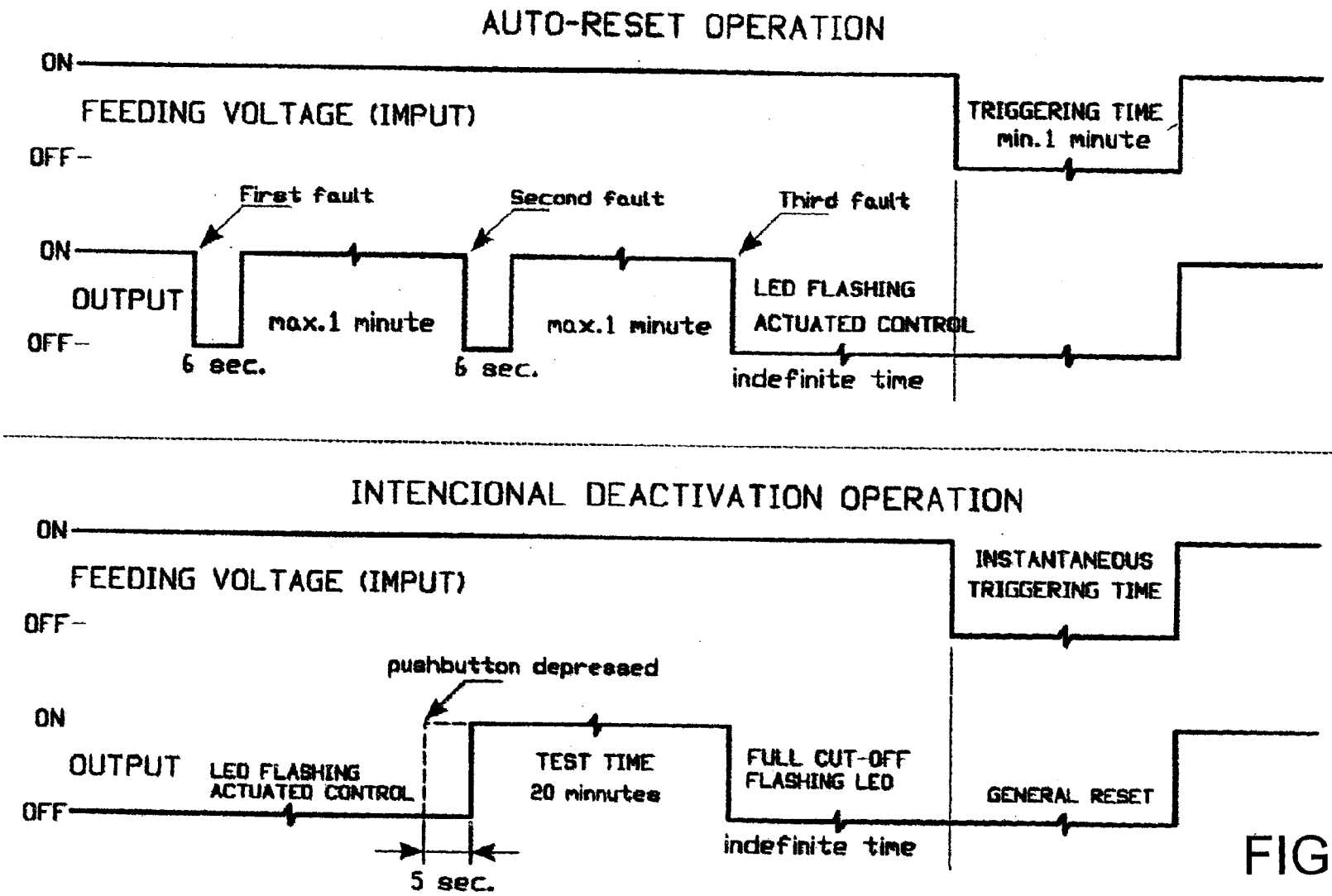
FIG. 2 is a timing diagram showing the schedules of operation of the present invention.

For the practical operation of the monitor for detecting failures in the installation of neon gas sign transformers 5, an electronic circuit based on a programmed digital micro-controller 2, was developed, what can be better understood by referring to the accompanying schematic drawings. FIG. 1 is a block diagram developed for this operation. FIG. 2 is a time schedule that shows what happens to the primary voltage and the secondary voltage when failures occur.

Figure 3:
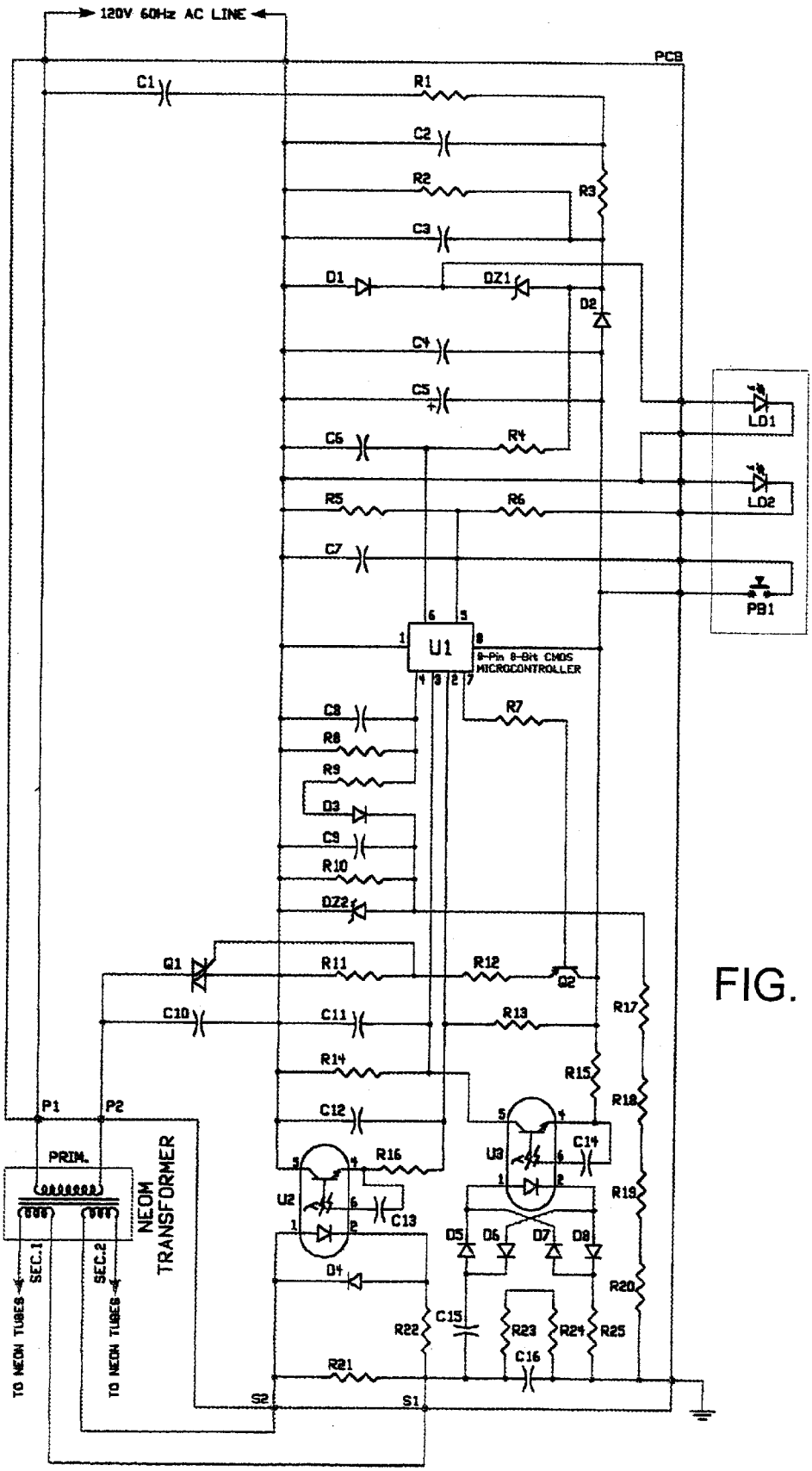
FIG. 3 is a schematic circuit diagram of the present invention. In the drawings.

FIG. 3 is a schematic diagram of the electrical circuit for protecting against lack of grounding.

In accordance with the schematic figures, in the block diagram of FIG. 1 it can be seen that the invention comprises the power supply 1 that reduces to 5V DC, distribution network voltage stabilized by means of a Zener diode and also supplies the network synchronism signal to the micro-controller 2. The diagram of the power supply circuit 1 was optimized in order to attain high efficiency and low cost, volume and weight in view of the elimination of a feeding transformer and also provides high resistance to noise, a usual problem in circuits that operate connected to a distribution or power network. The micro-controller 2 sends triggering pulses to the TRIAC 4 with a working cycle of 6.5% (7 $\mu$s on, 100 $\mu$s off), thus assuring the practically continuous triggering with an average current value quite reduced. The triggering circuit contained in the TRIAC 4 only supplies negative pulses by operating the TRIAC in the second and third quadrants and contains a transistor that increases the triggering current from the micro-controller 2.

These characteristics allow an efficient and reliable triggering, thus not requiring the use of special TRIACs that are highly sensitive and expensive. Since the operation of the micro-controller 2 is synchronous, it was possible to adjust the initial triggering angle to an ideal value thus assuring that the magnetizing current surge can be reduced to the lesser possible value. The micro-controller 2 receives the information from the neon gas sign transformer 5 secondary currents, by means of the optical coupler 3 and related components for suitably attaining the right levels and assuring the required insulation. The micro-controller 2 is provided with two display LED's having the following functions: a green power LED 6—that is continuously activated to indicate the power. input from the distribution network; a red failure LED 7—that remains deactivated under normal operation to indicate a failure and blinks when the transformer is switched off, thus showing the type of failure that took place in the installation; and a deactivating button 8 that allows the circuit protecting function to be intentionally deactivated. The information that indicates the type of failure that occurred in the installation is supplied by the time schedule, as can be seen in top of FIG. 2, while the deactivating button 8 provided to make it easier to find the failure for maintenance purposes of the neon gas sign is controlled in the time schedule, as can be seen in bottom scheme of FIG. 2 and shown in details in FIG. 3. The monitor operates by means of a software specially developed for this application and contains, in the "RISC" language, the instructions that make it possible to generate all the delay times and the verification of the interlocking and logical conditions required for the perfect execution of the functions it was developed to.

While a specific embodiment of the invention has been shown and described in detail to illustrate the application of the principles of the invention, it will be understood that the invention may be embodied otherwise without departing from such principles.

What is claimed is:

1. A monitor for detecting failures of a neon gas sign transformer having a primary coil powered by a power distribution network, the monitor comprising:

an electronic circuit with a programmed digital micro-controller that is connected to the neon gas sign transformer for controlling a turning off of the transformer if any one of a plurality of failures occurs;

the transformer having a secondary coil connected to a ground wire through an optical coupler;

an output signal of the optical coupler being connected to the micro-controller for providing the micro-controller with a current status of a condition of the secondary coil of the transformer;

a TRIAC;

a red and a green LED connected to the micro-controller the micro-controller supplying an exciting current to the TRIAC that turns on/off the primary coil of the transformer under an AC tension of the distribution network and also supplies a current to turn on the red LED when there is a failure and the green LED that indicates if any power is being fed from the distribution network to the transformer.

2. The monitor of claim 1, including a power supply (1) connected to the distribution network for stepping power from the distribution network down to a DC voltage; the power supply containing a Zener diode; the micro-controller being connected to the power supply with the Zener diode filtering out noise from the distribution network to the micro-processor.

3. The monitor according to claim 1, wherein the micro-controller includes means for sending triggering pulses to the TRIAC at a rate for assuring substantially continuous triggering the TRIAC only supplying negative pulses to the primary coil of the transformer.

4. The monitor according to claim 1, wherein the micro-controller is connected to receive information from the secondary coil of the transformer, the optical coupler being connected to the micro-controller, the micro-controller generating the current to turn on the red LED when a current level is out of the selected range or is interrupted from the secondary coil.

5. A monitor according to claim 1, including a deactivating button connected to the micro-processor for interrupting power from the TRIAC to the primary coil of the transformer for permitting a circuit protection function to be deactivated.

6. The monitor according to claim 1, wherein micro-controller is programmed to cause at least one of the LED's to blink at different rates depending on the type of failure detected, the monitor including a deactivating button connected to the micro-controller for deactivating powering of the primary coil for a selected period of time to permit maintenance to be performed on the transformer.

7. The monitor according to claim 1, wherein the plurality of failures comprises a first failure indicating a failure of at least one neon tube of the neon gas sign connected to the transformer, a second one of the failures comprises a current leakage from a wire of the secondary coil of the transformer and a third one of the failures comprises a lack of connection to ground, the micro-processor including means for blinking at least one of the LEDs by different rates depending on the type of failure detected and means connected between the transformer and the micro-processor for detecting and indicating to the micro-processor the type of failure that has occurred.

* * * * *